US005931694A

United States Patent [19]

Kato et al.

[11] Patent Number: 5,931,694

[45] Date of Patent: Aug. 3, 1999

[54] LEVER HOLDING MECHANISM OF SERVICE PLUG

[75] Inventors: Hisaharu Kato; Hidehiko Kuboshima; Mizuko Matsumura, all of Shizuoka, Japan

[73] Assignee: Yazaki Corporation, Tokyo, Japan

[21] Appl. No.: 08/919,364

[22] Filed: Aug. 28, 1997

[30] Foreign Application Priority Data

Sep. 11, 1996 [JP] Japan ..... 8-240682

[51] Int. Cl.[6] ..... H01R 31/08

[52] U.S. Cl. ..... 439/511

[58] Field of Search ..... 439/511, 512, 439/509, 510, 484

[56] References Cited

U.S. PATENT DOCUMENTS 5,321,203 6/1994 Goto et al. ..... 439/509
5,399,103 3/1995 Kuboshima ..... 439/509
5,679,014 10/1997 Lan-Jen ..... 439/484

FOREIGN PATENT DOCUMENTS

0790677A2 8/1997 European Pat. Off. .
2227132 7/1990 United Kingdom ..... 439/484

*Primary Examiner*—Steven L. Stephan
*Assistant Examiner*—J. F. Duverne
*Attorney, Agent, or Firm*—Sughrue, Mion, Zinn, Macpeak & Seas, PLLC

[57] ABSTRACT

A service plug includes: a plug main body having terminals for engaging with the other terminals, the terminals electrically connected to each other; a pivoting shaft extending in a direction substantially orthogonal to a terminal engaging direction of the terminals of the plug main body and the other terminals; a lever connected to the plug main body so as to be pivotally movable through the pivoting shaft; and a pivot regulating mechanism arranged to extend over the lever and the plug main body, the pivot regulating preventing the pivoting of the lever relative to the plug main body with a predetermined force at least when the lever is substantially erected in the terminal engaging direction.

6 Claims, 9 Drawing Sheets

LEVER HOLDING MECHANISM OF SERVICE PLUG

BACKGROUND OF THE INVENTION

1. Field of the Invention

This invention relates to circuit switchgears (service plugs) that can open electric circuits to interrupt circuit current. More particularly, the invention is directed to a lever holding mechanism that can hold a lever in an erect position so that operability is improved, the folding type lever being foldable by pivoting.

2. Background

In switchboards for high-voltage circuits and the like, a circuit switchgear is constructed in the following manner lest an operator should receive an electric shock. When the cover of a switchboard has been opened, a plug disposed on the switchboard is pulled out of a terminal fixed to the switchboard main body so that the circuit current is interrupted.

Recently, electric cars attract attention as nonhazardous vehicles with no emission. Since such electric cars have high-voltage circuits for driving motors, it is also necessary to interrupt circuit current in servicing the cars for the same reason. To meet such needs, proposed for conventional electric cars is a circuit switchgear (connector device) that contains a high-voltage circuit inside a switchboard and that causes the high-voltage circuit to be automatically electrically opened when the cover of the switchboard has been opened.

FIG. 9 is a perspective view showing a conventional connector device, and FIG. 10 is a sectional view of a cover closing process of the conventional connector device. A female connector 3 is fixed inside a box-like housing 1 whose upper surface is opened. The female connector 3 is connectable to external high-voltage wires 5*a*, 5*b* through a connector terminal 6. A cover 7 for opening and closing the opening of the housing 1 is arranged on the housing 1. The cover 7 is pivotally movable about pivoting shafts 9. A guide 11 is disposed on the cover 7. The guide 11 holds a male connector 13 and a guide member 15 so that the male connector 13 and the guide member 15 are movable in a direction orthogonal to the pivoting shafts 9. Further, as shown in FIG. 10, a spring 17 is interposed between the internal wall of the guide 11 and the male connector 13. The spring 17 urges the male connector 13 and the guide member 15 toward the pivoting shafts 9.

In the connector device 19, when the cover 7 has been closed, the male connector 13 nears the female connector 3 while depicting an arcuate locus about the pivoting shafts 9. Therefore, in the process of engaging with the female connector 3, the male connector 13 moves away from the pivoting shafts 9 against the urging force of the spring 17 by the guide member 15 coming in contact with an internal wall 20*a* of a guide hole 20, and then the male connector 13 moves closer to the pivoting shafts 9 through the urging force of the spring 17 again. Accordingly, the male connector 13 engages with the female connector 3 while absorbing a displacement caused by the arcuate locus during the engaging process, so that conduction between the high-voltage wires 5*a*, 5*b* can be established.

On the other hand, when the cover 7 has been opened, the male connector 13 gets out of the female connector 3 while moving away from the pivoting shafts 9 again, so that the high-voltage circuit between the high-voltage wires 5*a*, 5*b* is electrically opened and the circuit current is hence automatically interrupted.

However, in the aforementioned conventional circuit switchgear, the male connector 13 is disposed on the cover 7 and the male connector 13 is engaged with and disengaged from the female connector 3 by opening and closing the cover 7 so that the high-voltage circuit can be automatically opened and closed. Therefore, there is a possibility that an operator will erroneously close the cover 7 during inspection. For this reason, it is preferable to be considered that the circuit switchgear be of such a structure that a plug main body or the like having short-circuit terminals integrally arranged thereon can be completely separated from a circuit accommodating body.

Further, in the aforementioned circuit switchgear, no handle such as a lever is arranged on the cover 7. Therefore, the cover opening and closing operation has been difficult. If a lever is arranged so as to simply project from the cover 7 to overcome the aforementioned problem, such lever becomes a hindrance in an electric car or the like in which only a limited component mounting space is available. Further, even if a folding type lever being folded by pivoting is arranged on the cover 7, the folding type lever imposes the problem of impaired operability with the lever pushing or pulling force not being applied in the same direction as the terminal engaging and disengaging direction due to the pivot of the folding type lever.

SUMMARY OF THE INVENTION

The invention has been made in view of the aforementioned circumstances. The object of the invention is, therefore, to provide a lever holding mechanism that can implement satisfactory operability for attaching and detaching a plug main body to and from a circuit accommodating body in a circuit switchgear (service plug) which has a folding type lever being foldable by pivoting and in which the plug main body can be separated from the circuit accommodating body.

To achieve the above object, the invention is applied to a lever holding mechanism of a service plug that includes: a plug main body having short-circuit terminals for engaging with the other terminals, the short-circuit terminals electrically conducted each other; a pivoting shaft extending in a direction substantially orthogonal to a terminal engaging direction of the short-circuit terminals of the plug main body and the other terminals; a lever connected to the plug main body so as to be pivotally movable through the pivoting shaft; and a pivot regulating mechanism arranged to extend over the lever and the plug main body, the pivot regulating mechanism being regulatable the pivoting of the lever relative to the plug main body with a predetermined force at least when the lever is substantially erected in the terminal engaging direction.

The pivot regulating mechanism may include a recess and a projection, the recess being formed in one of the lever and the plug main body, the projection being formed on the other one of the lever and the plug main body, and the projection is engageable with the recess and is releasable the engagement with the recess by a force exceeding the predetermined force.

The pivoting shaft may be fixed to the plug main body, and the pivot regulating mechanism includes a grooved shaft and a resilient contact member, the grooved shaft having a recessed groove around an outer circumference thereof and being fixed to the pivoting shaft concentrically, the resilient contact member engageable with the recessed groove of the grooved shaft while fixed to the lever, and releasable the engagement with the recessed groove by a force exceeding the predetermined force.

In the thus constructed lever holding mechanism of a service plug, the lever is held in the erect condition with respect to the plug main body by the pivot regulating mechanism regulating the pivoting of the lever relative to the plug main body, so that the lever pushing or pulling force can be applied in the same direction as the short-circuit terminal engaging and disengaging direction. Further, the released plug main body, keeping the lever held linearly with respect to the short-circuit terminals, can regulate the unstable pivoting of the lever relative to the plug main body before the short-circuit terminals are inserted.

Further, in the lever holding mechanism that includes a recess and a projection that engages with the recess, the lever holding mechanism can be of a comparatively simple structure.

Still further, in the lever holding mechanism having the pivot regulating mechanism constructed of a grooved shaft fixed to the pivoting shaft and an resilient pressure contact member engaging with a recessed groove formed in the grooved shaft, the lever holding force can be set arbitrarily by adjusting the resilience of the resilient pressure contact member.

DETAILED DESCRIPTION OF THE PREFERRED EMBODIMENTS

First Embodiment

Lever holding mechanisms, which are a first preferred embodiment of the invention, will now be described in detail with reference to FIGS. 1 to 5B.

Figure 2:
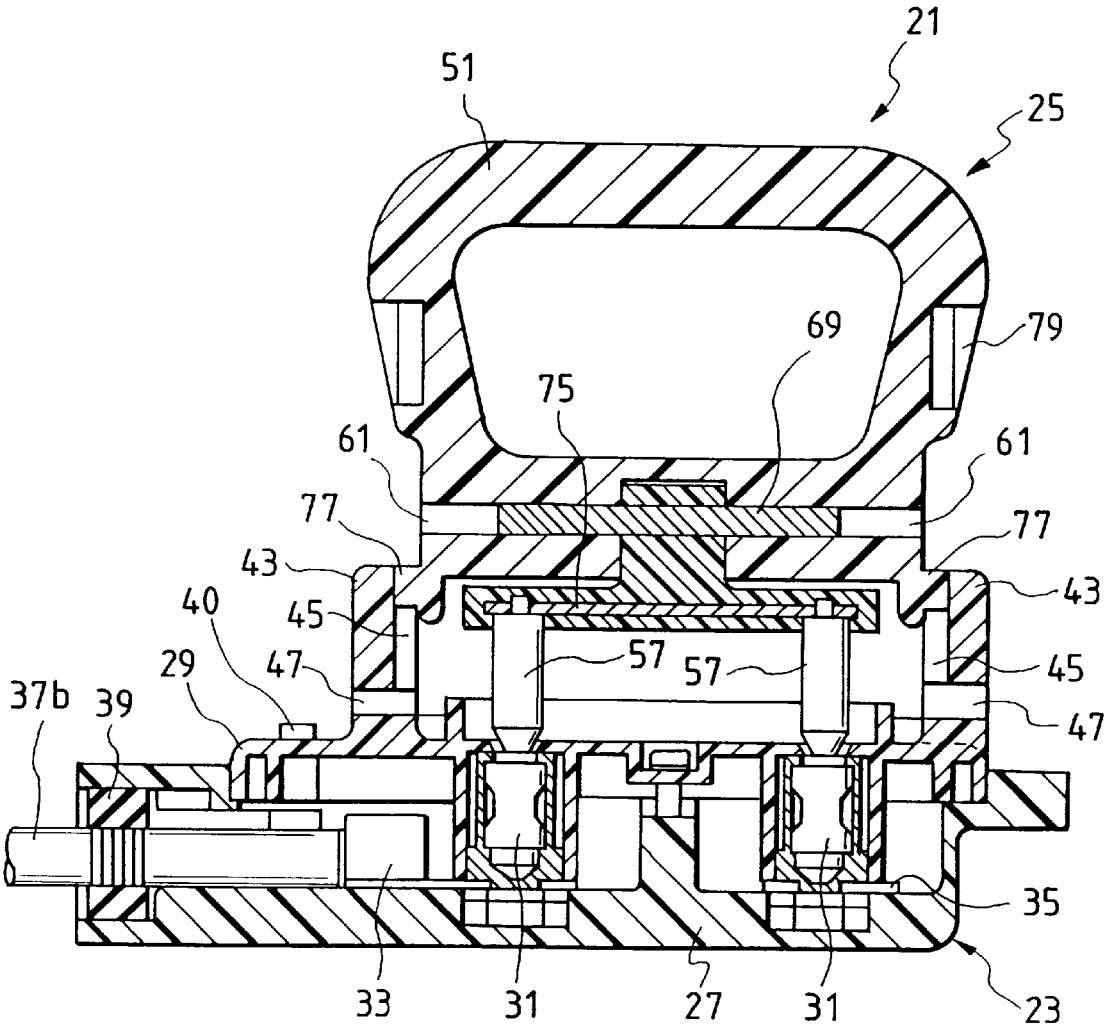
FIG. 2 is a sectional view showing a service plug having the lever holding mechanism shown in FIG. 1 at the time a detachable plug starts engagement.

As shown in FIG. 2, a service plug 21, which is a circuit switchgear, includes a circuit accommodating body 23, and a detachable plug 25 that is detachably attached to the circuit accommodating body 23. The circuit accommodating body 23 includes a box section 27 having the upper portion which is opened, and a cover 29 that covers the opening of the box section 27. A plurality of female terminals 31, 31 (two in this example), which are cylindrical circuit terminals, are erected on the box section 27 side by side. The female terminals 31, 31 engage with mating terminals while allowing the mating terminals to be inserted thereinto vertically (vertically as viewed in FIG. 2). High-voltage wires 37*a*, 37*b* are electrically connected to the female terminals 31, 31 through terminals 33 or bus bars 35, respectively. The high-voltage wires 37*a*, 37*b* are led outside with spaces thereof with respect to the box section 27 sealed by rubber plugs 39 so as to be watertight.

Figure 4:
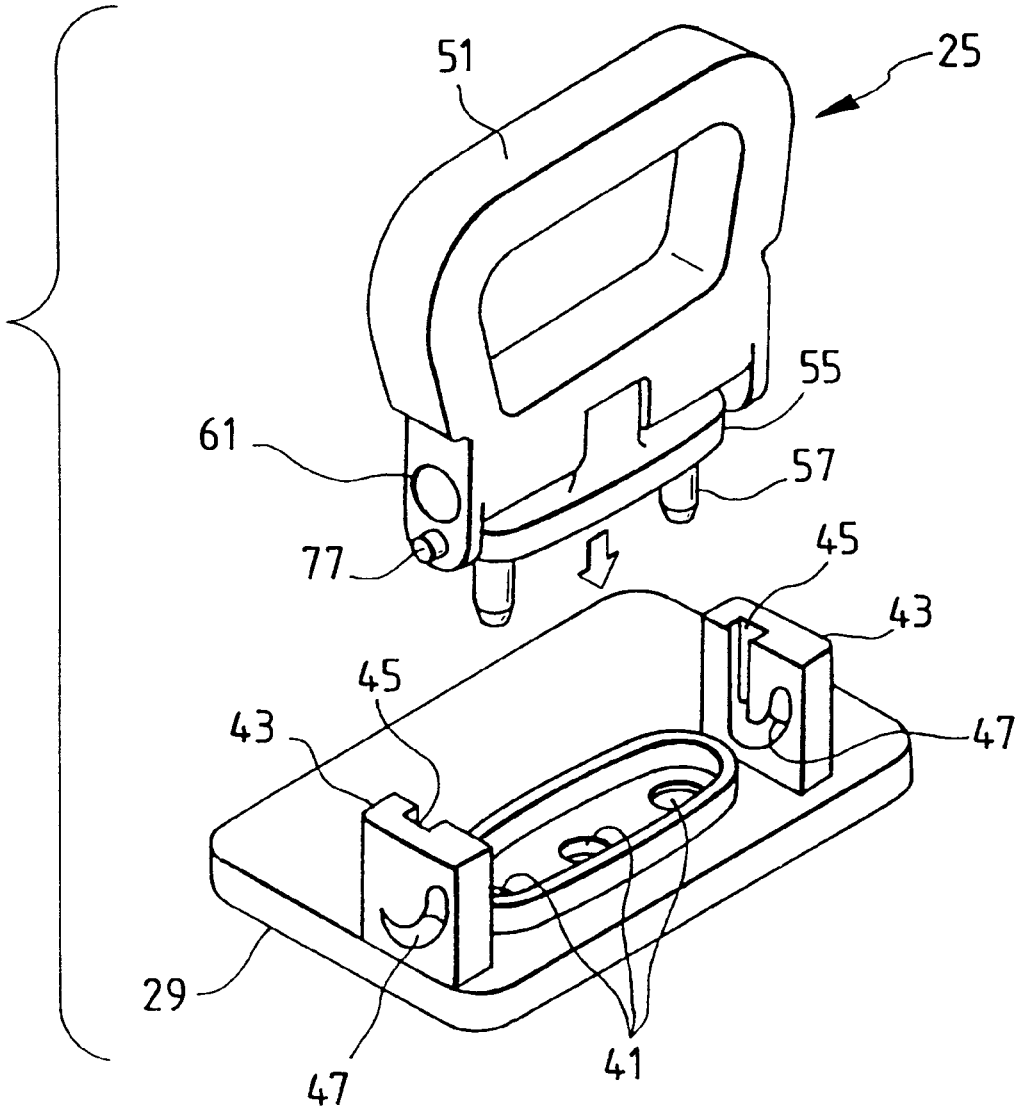
FIG. 4 is a perspective view showing the service plug shown in FIG. 2 before the detachable plug is engaged.

The cover 29 is mounted on the opened upper portion of the box section 27 by screws 40. The cover 29 has terminal insertion holes 41 (see FIG. 4) bored so as to correspond to the female terminals 31, 31. The center of each terminal insertion hole 41 coincides with the center of engagement of the corresponding female terminal 31. A pair of parallelly extending guide walls 43, 43 are erected on both sides of the upper surface of the cover 29, both sides interposing the terminal insertion holes 41 therebetween. As shown in FIG. 4, vertically extending elongated guide grooves 45 are formed in the confronting surfaces of the guide walls 43, 43, the upper ends of the guide grooves 45 being opened at the upper ends of the guide walls 43, 43. Arcuate evacuation holes 47 are also formed in the lower portions of the guide grooves 45 so as to communicate with the guide grooves 45. The evacuation holes 47 may be arcuate grooves that do not pass through the guide walls 43, 43.

Figure 3:
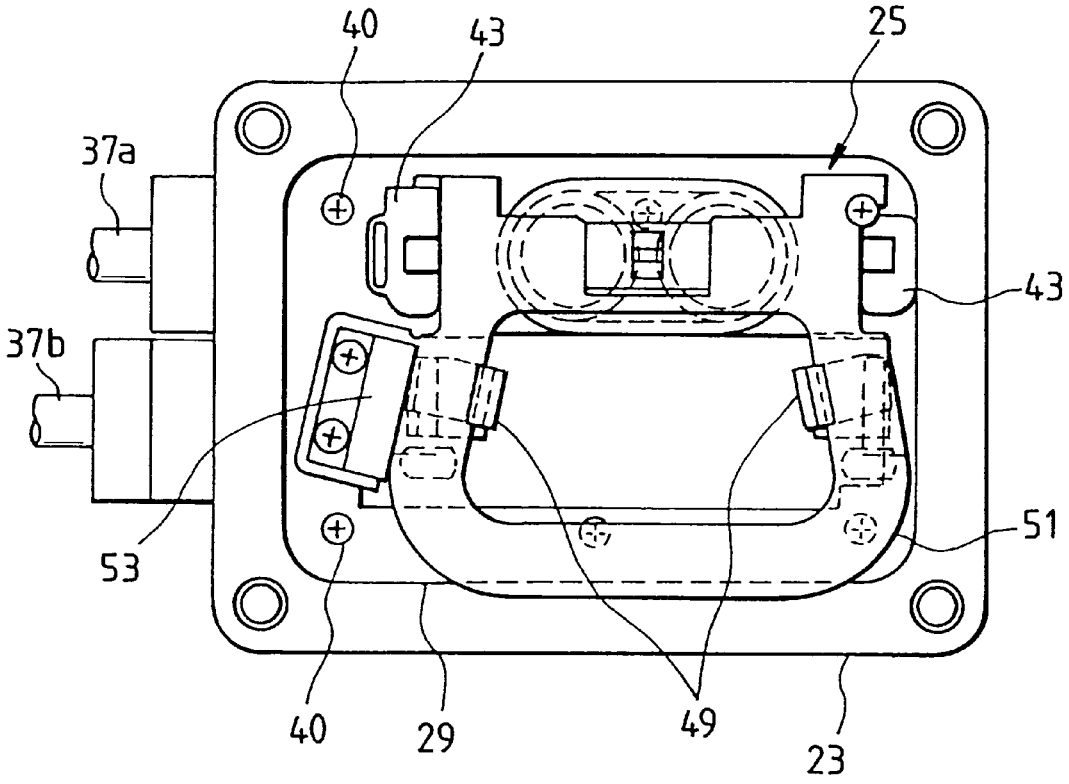
FIG. 3 is a plan view showing the service plug shown in FIG. 2 with a lever folded down.

As shown in FIG. 3, lever locks 49 are disposed on the cover 29. The lever locks 49 grip a lever 51 of the detachable plug 25, which will be described later, and hold the lever 51 on the cover 29 in a folded condition. The cover 29 has a limit switch 53, which makes and breaks the switch contact by means of electromagnetism.

Figure 1:
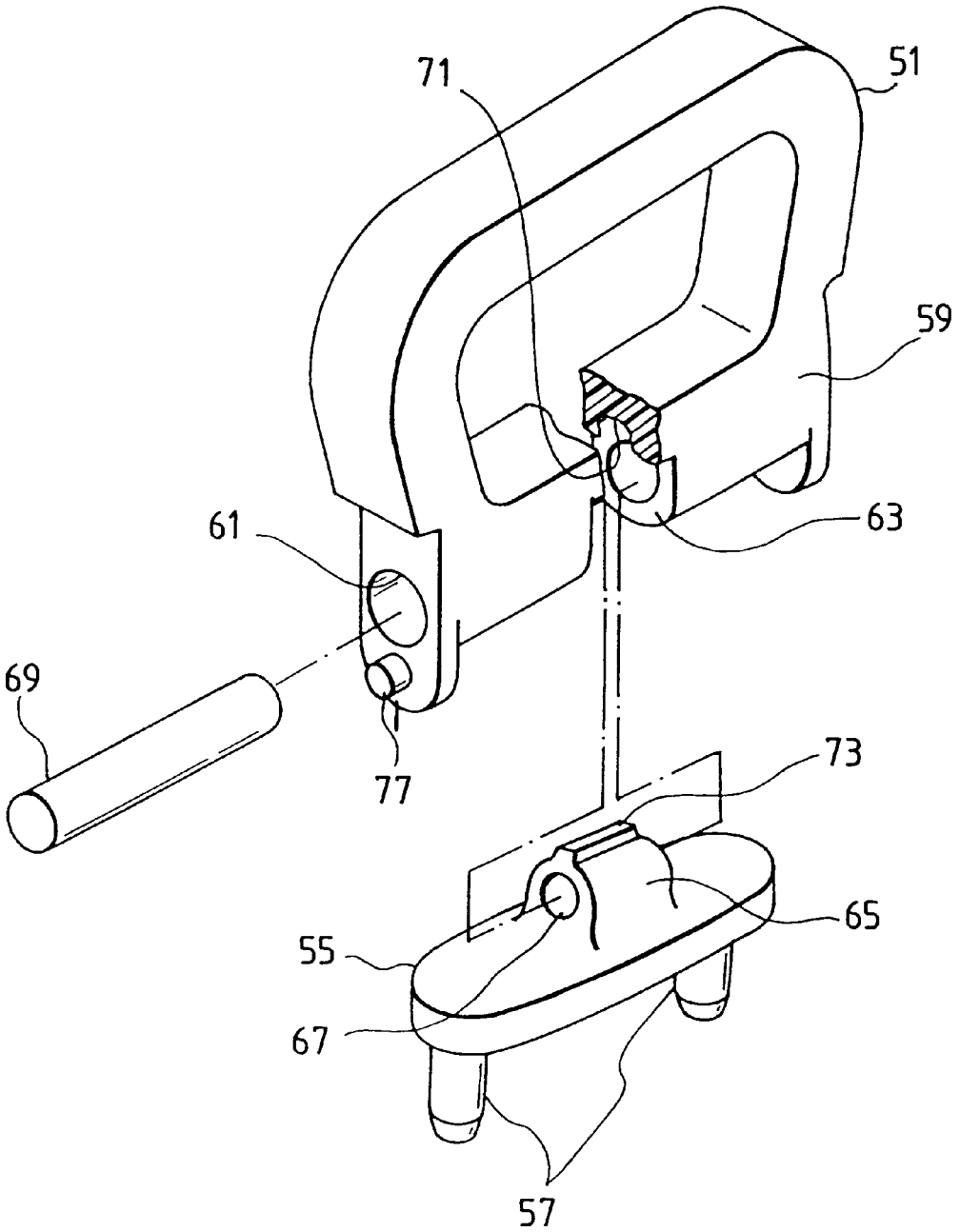
FIG. 1 is an exploded perspective view showing a lever holding mechanism, which is a first preferred embodiment of the invention.

On the other hand, as shown in FIG. 1, the detachable plug 25 includes: the aforementioned lever 51 that is formed into, e.g., a rectangular frame; a plug main body 55 that is pivotally coupled to the lever 51; and male terminals 57, 57 that are short-circuiting terminals projecting from the plug main body 55. One of the sides of the rectangular-frame lever 51 serves as a coupling rod 59. A pivoting shaft through hole 61 that passes through the coupling rod 59 as far as to both side surfaces of the coupling rod is formed in the coupling rod. A coupling recess 63 that is notched so as to divide the pivoting shaft through hole 61 is formed in the middle of the coupling rod 59.

A coupling projection 65 engageable with the coupling recess 63 is arranged on the plug main body 55 so as to project therefrom. A pivoting shaft through hole 67 that passes through the coupling projection 65 as far as to both side surfaces of the coupling projection is formed in the coupling projection. The lever 51 and the plug main body 55 can be pivotally coupled to each other by engaging the coupling projection 65 with the coupling recess 63 and by inserting a pivoting shaft 69 into the pivoting shaft through holes 61, 67.

A recess 71, which is a pivot regulating mechanism, is formed in the inner surface that faces the coupling recess 63. Further, from the outer surface of the coupling projection 65 projects a projection 73, which is the pivot regulating mechanism and which is engageable with the recess 71. The recess 71 and the projection 73 are designed to engage with each other when the lever 51 is in an erect condition with respect to the plug main body 55 (the conditions shown in FIGS. 1, 2, and 4). The recess 71 and the projection 73 are of a so-called "semi-locked structure" in which the recess 71 is disengaged from the projection 73 when a force exceeding a predetermined value is applied thereto. Therefore, the folded lever 51 is held in the erect position by a predetermined pivot blocking force applied as a result of the recess 71 having engaged with the projection 73 when the folded lever 51 has been raised from the plug main body 55, and the lever 51 is folded down by pivoting about the pivoting shaft 69 as a result of the recess 71 having disengaged from the projection 73 when the lever 51 has been pivoted by the force exceeding the predetermined value.

The plug main body 55 has the aforementioned plurality of male terminals 57, 57 (two in this example) on a surface opposite to the coupling projection 65 so as to project therefrom. The male terminals 57, 57 are disposed at the same interval as the terminal insertion holes 41. A bus bar 75 (see FIG. 2) is arranged inside the plug main body 55 so as to establish conduction between the two male terminals 57, 57. That is, by inserting the male terminals 57, 57 into the terminal insertion 15 holes 41, the male terminals 57, 57 are engaged with the female terminals 31, 31, so that the detachable plug 25 can short-circuit the female terminals 31, 31.

Bosses 77, 77 are arranged so as to project from the side surfaces of the coupling rod 59 of the lever 51, the bosses projecting in the same direction as the pivoting shaft 69. The bosses 77, 77 are disposed at positions on the male terminal 57, 57 projecting side with respect to the pivoting shaft 69. The diameter and project ing length of the bosses 77, 77 are set so that the bosses 77 are fitted into the guide grooves 45 of the aforementioned guide walls 43, 43. Further, the bosses 77, 77 and the male terminals 57, 57 are so 30 designed that the front ends of the male terminals 57, 57 enter into the terminal insertion holes 41 immediately after the bosses 77, 77 have been inserted into the guide grooves 45.

A magnet 79 is disposed inside the lever 51 (see FIG. 2). The magnet 79 is disposed so as to confront the limit switch 53 with the lever 51 folded down and held by the lever locks 4c.

The operation of the thus constructed service plug 21 will be described.

The service plug 21 closes a high-voltage current circuit with the male terminals 57, 57 short-circuiting the female terminals 31, 31 with the detachable plug 25 inserted into the circuit accommodating body 23. With the detachable plug attached, the lever 51 is folded down about the pivoting shaft 69 (see FIGS. 3 and 5 (A)), and the lever 51 is held on the upper surface of the cover 29 by the lever locks 49. The limit switch 53 disposed on the cover 29 confronts the magnet 79 of the lever 51 under this condition, thereby operating the contact thereof by means of magnetism of the magnet 79 and detecting the lever 51 in the held condition.

Figure 5A:
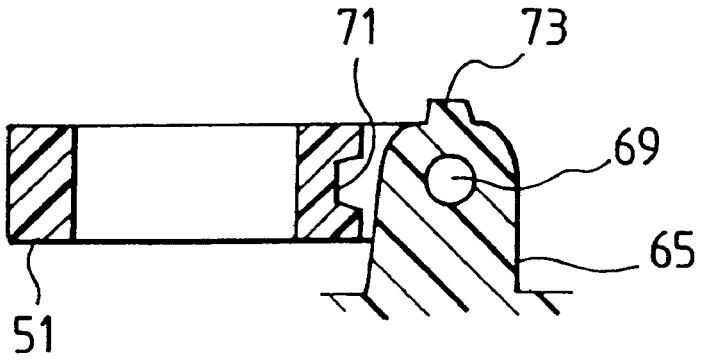
FIGS. 5A and 5B are side views of main portions showing a relationship between the lever position and the recess and projection of the lever holding mechanism of the invention.
Figure 5B:
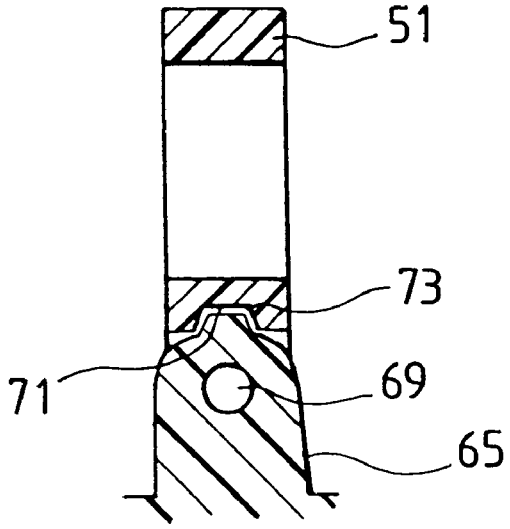

For attaching and detaching the detachable plug 25, the lever locks 49 are released so that the lever 51 is erected. As shown in FIG. 5 (B), the erect lever 51 keeps the erect position with the pivoting thereof regulated by the recess 71 having engaged with the projection 73.

Accordingly, the magnet 79 of the lever 51 moves away from the limit switch 53, and the limit switch 53 detects that the held condition of the lever 51 has been released.

Then, the lever 51 is pulled out of the circuit accommodating body 23 in a releasing direction with the lever 51 held by a hand, so that the male terminals 57, 57 are disengaged from the female terminals 31, 31, which in turn opens the high-voltage circuit between the female terminals 31, 31. Accordingly, the high-voltage current is interrupted.

The detachable plug 25 released from the circuit accommodating body 23 regulates the pivoting of the lever 51 relative to the plug main body 55 by keeping the recess 71 engaged with the projection 73, so that the erect direction of the lever 51 and the projecting direction of the male terminals 57, 57 are kept linear. That is, the detachable plug 25 that has been released is designed so that the plug main body 55 is never allowed to pivot about the pivoting shaft 69 unstably when the lever 51 is gripped.

On the other hand, for inserting the detachable plug 25 into the circuit accommodating body 23, the bosses 77, 77 on both side surfaces of the lever 51 are inserted into the guide grooves 45 of the guide walls 43, 43 with the lever 51 held by a hand. The detachable plug 25 is inserted into the circuit accommodating body 23 with the front ends of the male terminals 57, 57 entering into the terminal insertion holes 41 immediately after the bosses 77, 77 have entered into the guide grooves 45. At this time, since the lever 51 is integrated with the male terminals 57, 57 linearly, the detachable plug 25 regulates the unstable pivoting of the lever 51 relative to the plug main body 55, which in turn facilitates the positioning of the male terminals 57, 57 through the operation of the lever 51 and hence contributes to providing satisfactory insertibility.

The detachable plug 25 further regulates the pivoting thereof relative to the circuit accommodating body 23 about the bosses 77, 77 with the bosses 77, 77 having engaged with the guide grooves 45 and with the front ends of the male terminals 57, 57 having entered into the terminal insertion holes 41, so that the detachable plug 25 thereafter keeps the erect position. It may be noted that under the condition in which the bosses 77, 77 have engaged with the guide grooves 45 and that the front ends of the male terminals 57, 57 have entered into the terminal insertion holes 41, the pivoting of the lever 51 relative to the plug main body 55 can be regulated even if the recess 71 and the projection 73 are absent, because the bosses 77, 77 are shifted from the pivoting shaft 69.

Then, when the lever 51 has been pushed into the circuit accommodating body, the male terminals 57, 57 engage with the female terminals 31, 31, and at the same time, the bosses 77, 77 reach the evacuation holes 47.

The relative pivoting of the lever 51 regulated by the guide grooves 45 is deregulated by the bosses 77, 77 having reached the evacuation holes 47, and therefore the lever 51 can pivot about the pivoting shaft 69. By pivoting the lever 51 with a force exceeding a predetermined value thereafter, the semi-locked condition of the recess 71 and the projection 73 is released, and then the lever 51 is folded by causing the bosses 77, 77 to enter into the evacuation holes 47. By causing the lever locks 49 to hold the folded lever 51, the limit switch 53 is operated by the magnet 79, so that the limit switch 53 detects that the lever 51 has been held again.

As described above, according to the aforementioned service plug 21, the circuit accommodating body 23 is independent of the plug main body 55, and the plug main body 55 can be completely separated from the circuit accommodating body 23. Therefore, the aforementioned service plug 21 can obviate a danger that an operator will receive an electric shock by erroneously closing the cover during inspection as in the conventional circuit switchgear that has the short-circuit terminals formed on the opening and closing cover.

According to the lever holding mechanism of the service plug 21, the pivoting of the lever 51 relative to the plug main body 55 can be regulated by engaging the recess 71 with the projection 73, so that the lever 51 can be held in the erect position with respect to the plug main body 55. Therefore, the lever 51 pushing or pulling force can be applied in the same direction as the male terminal 57, 57 engaging and disengaging direction, which in turn provides satisfactory operability in attaching and detaching the detachable plug 25.

Further, since the pivot regulating mechanism can be constructed only of the recess 71 and the projection 73, the lever holding mechanism can be prepared in a comparatively simple structure and at a low price.

Further, the detachable plug 25 that has been released, keeping the lever 51 and the male terminals 57, 57 linearly, can regulate the unstable pivoting of the lever 51 relative to the plug main body 55 before the male terminals 57, 57 are inserted into the terminal insertion holes 41, which in turn provides satisfactory insertibility of the male terminals 57, 57 into the terminal insertion holes 41.

Second Embodiment

Figure 6:
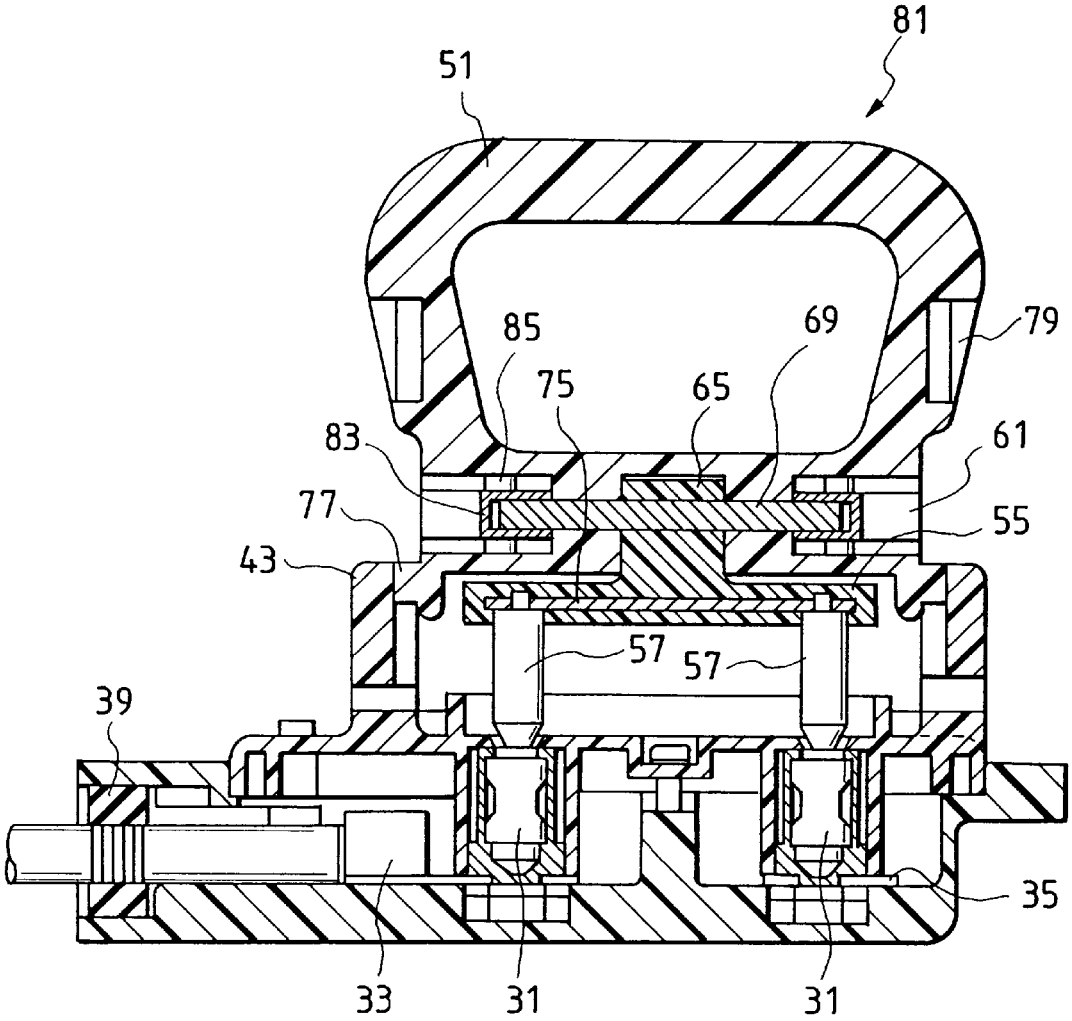
FIG. 6 is a sectional view showing a lever holding mechanism, which is a second embodiment of the invention.
Figure 7:
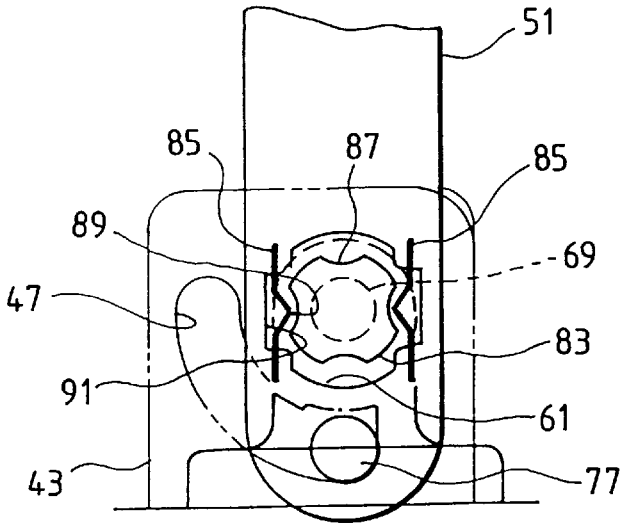
FIG. 7 is a side view showing a main portion of the lever holding mechanism shown in FIG. 6.

A service plug, which is a second embodiment of the invention, will be described next with reference to FIGS. 6 to 8. It may be noted that the same parts and components as those shown in FIGS. 1 to 5 are denoted by the same reference numerals and that duplicate descriptions will be omitted.

A service plug 81 according to this mode of embodiment does not have the recess 71 and the projection 73 in the aforementioned service plug 21, but has a grooved shaft (feeling lock) 83 serving as a pivot regulating mechanism and a pair of resilient pressure contact members (feeling plates) 85, 85 serving as the pivot regulating mechanism, and has the pivoting shaft 69 unturnably fixed to the coupling projection 65 of the plug main body 55.

The feeling lock 83 is cylindrical and is fixed at both ends of the pivoting shaft 69 concentrically. A total of four recessed grooves 87 that extend along the length of the pivoting shaft 69 is formed every 90° over the outer circumference of the feeling lock 83.

On the other hand, each of the feeling plates 85, 85 is made of, e.g., a metal plate having resilience, and has a lock projection 89 arranged in the middle so as to project therefrom in mountainous form. The feeling plates 85, 85 are fixed to the inside of the pivoting shaft through hole 61 of the lever 51 so as to interpose the feeling lock 83 therebetween and so as to confront each other parallelly. The confronting feeling plates 85 cause the lock projections 89 thereof to come in pressure contact with the outer circumference of the feeling lock 83. The pivoting shaft through hole 61 has evacuation portions 91 on the back of the lock projections 89. The evacuation portions 91 accommodate the middle portions of the feeling plates 85, 85 flexing in such a direction as to move away from the feeling lock 83. The feeling lock 83 and the feeling plates 85, 85 are positioned relative to one another in such a manner that the lock projections 89 are fitted into one confronting pair of recessed grooves 87 when the lever 51 has been erected and that the lock projections 89 are fitted into the other confronting pair of recessed groove 87 when the lever 51 has been folded down. It may be noted that a feeling plate member 85 of a single piece type may also be applicable.

According to the lever holding mechanism of the thus constructed service plug 81, the lock projections 89 of the feeling plates 85, 85 are fitted into one confronting pair of recessed grooves 87 of the feeling lock 83 when the lever 51 has been erected, so that the pivoting of the lever 51 relative to the feeling lock 83 is regulated by a predetermined force. That is, the lever 51 is held by the plug main body 55 in the erect condition as shown in FIG. 7.

Figure 8A:
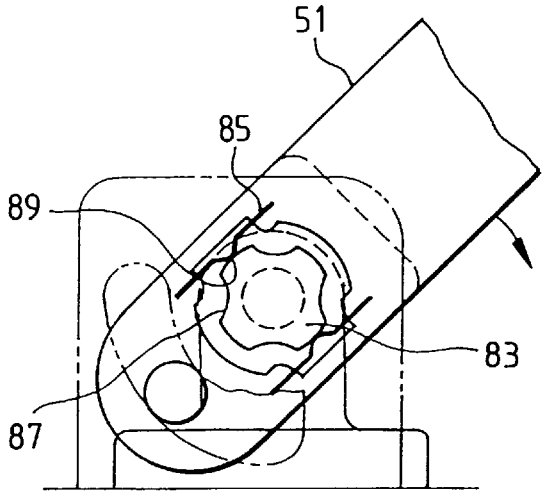
FIGS. 8A and 8B are side views showing a lever pivoting process of the lever holding mechanism shown in FIG. 6.
Figure 8B:
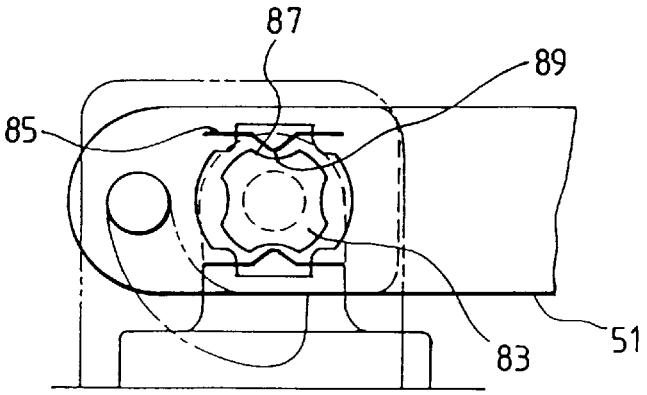
Figure 9:
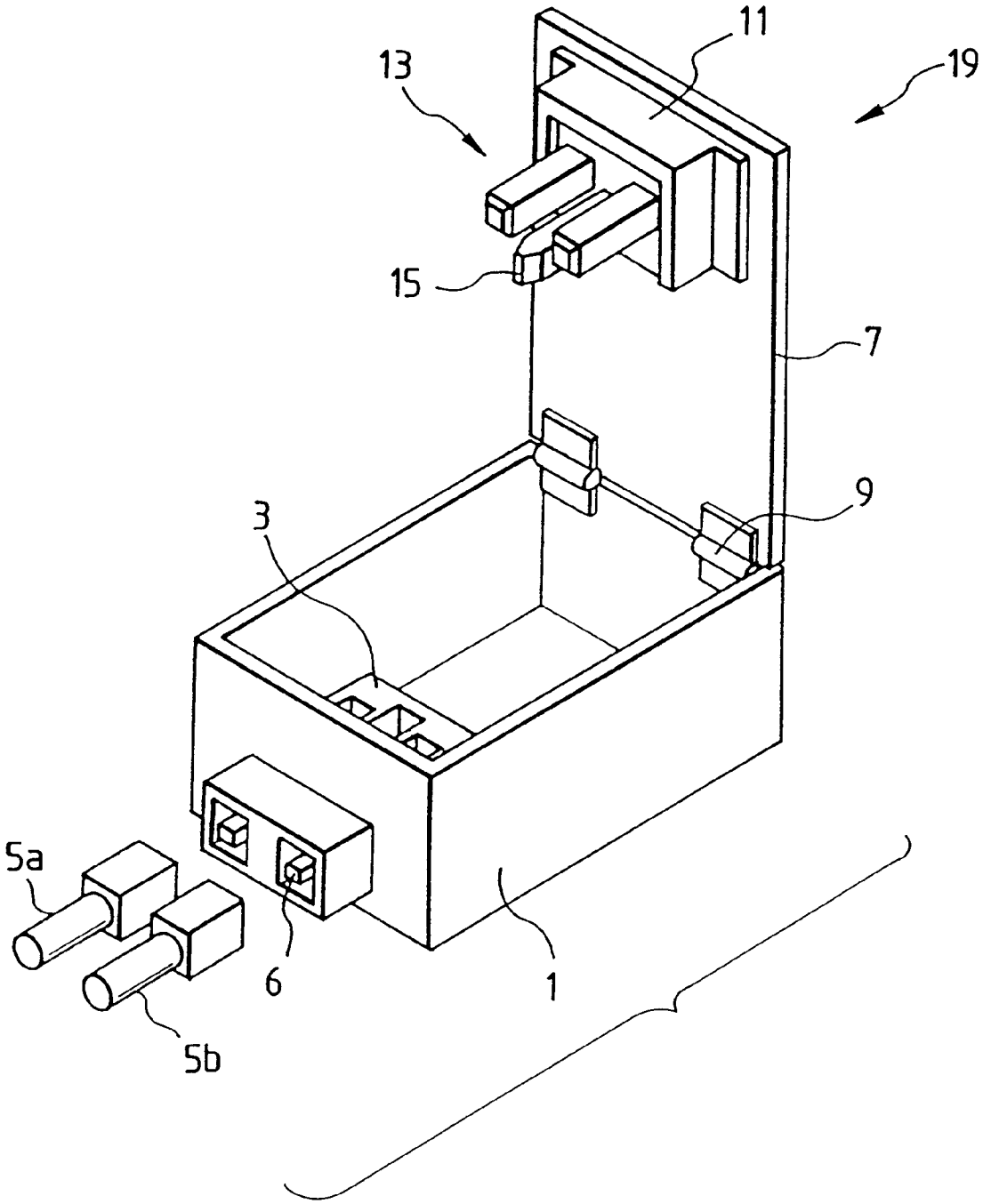
FIG. 9 PRIOR ART
FIG. 9 is a perspective view showing a conventional connector device.
Figure 10:
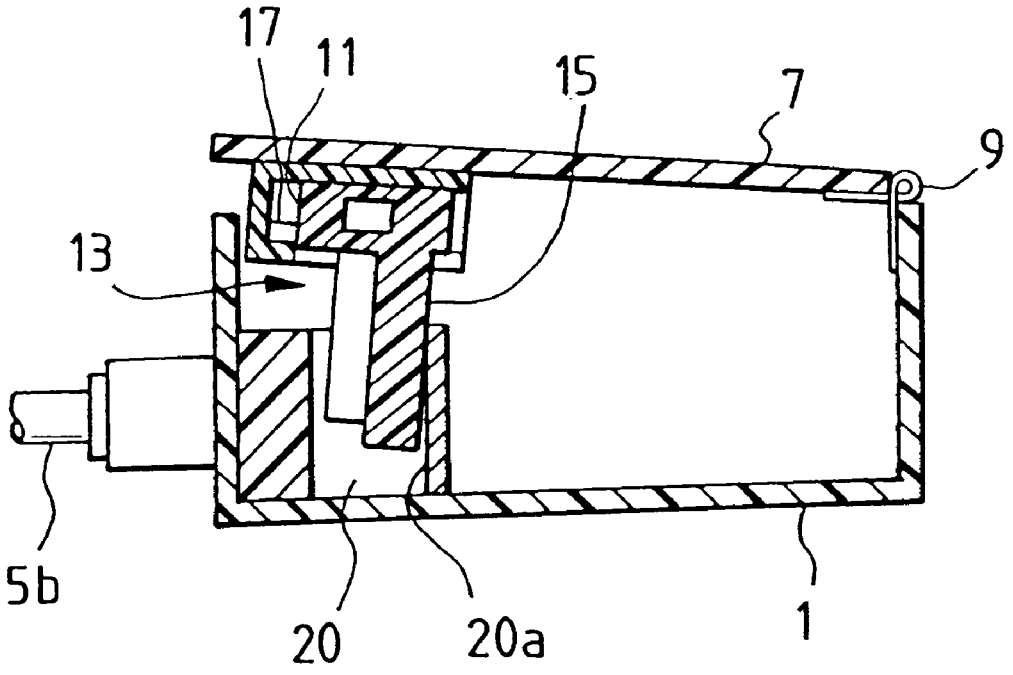
FIG. 10 PRIOR ART
FIG. 10 is a sectional view of a cover closing process of the conventional connector device.

On the other hand, when the lever 51 is pivoted by a force exceeding the predetermined value, the lock projections 89 come out of the confronting pair of recessed grooves 87 as shown in FIG. 8A, and slide on the outer circumference of the feeling lock 83 while flexing in such a direction as to move away from the feeling lock 83.

When the lever 51 is pivoted to the folded, accommodated position, the lock projections 89 are fitted into the other confronting pair of recessed grooves 87 of the feeling lock 83, which in turn regulates the pivoting of the lever again and hence allows the lever 51 to be held in the accommodated condition.

As described above, according to the lever holding mechanism of the aforementioned service plug 81, which is the second mode of the invention, the pivoting shaft 69 is fixed to the plug main body 55; the feeling lock 83 having the recessed grooves 87 is fixed at the end portions of the pivoting shaft 69; and the feeling plates 85, 85 having the lock projections 89 are fixed to the pivoting shaft through hole 61 of the lever 51. Therefore, by fitting the lock projections 89 into the recessed grooves 87 and by regulating the pivoting of the lever 51 relative to the pivoting shaft 69, the lever 51 can be held in the erect position and in the accommodated position. Accordingly, similar to the aforementioned service plug 21, the lever 51 pushing or pulling force can be applied in the same direction as the male terminal 57, 57 engaging and disengaging direction, and the unstable pivoting of the lever 51 relative to the plug main body 55 can be regulated, which in turn provides satisfactory operability in attaching and detaching the detachable plug 25.

Further, according to this lever holding mechanism, the lever 51 is held by the spring force of the feeling plates 85, 85, so that the lever 51 holding force can be set arbitrarily by adjusting the spring force of the feeling plates 85, 85.

While the feeling plates 85, 85 are used as the resilient pressure contact members in the aforementioned service plug 81, the resilient pressure contact members may also include pins, balls, and the like that are brought into pressure contact with the outer circumference of the feeling lock 83 by coil springs so that the pivoting of the lever 51 relative to the feeling lock 83 can be regulated.

As described in the foregoing in detail, the lever holding mechanism of the service plug of the invention, the pivot regulating mechanism for regulating the pivoting of the lever relative to the plug main body with a predetermined force when the lever is erected in the terminal engaging direction is arranged so as to extend over the lever and the plug main body. Therefore, the lever can be held in the erect position with respect to the plug main body, which in turn allows the lever pushing or pulling force to be applied in the same direction as the short-circuit terminal engaging and disengaging direction and hence provides the lever with satisfactory operability in attaching and detaching the plug main body. Further, the released plug main body, keeping the lever and the short-circuit terminals linearly, can regulate the unstable pivoting of the lever relative to the plug main body before the short-circuit terminals are inserted, which in turn provides satisfactory insertibility when the short-circuit terminals are to be inserted into the terminal insertion holes.

Further, according to the lever holding mechanism in which the pivot regulating mechanism includes the recess and the projection, the holding mechanism can be formed in a comparatively simple structure and at a low price.

Still further, according to the lever holding mechanism in which the pivot regulating mechanism includes the grooved shaft that is fixed to the pivoting shaft and the resilient pressure contact members that engage with the recessed grooves of the grooved shaft, the lever holding force can be set arbitrarily by adjusting the resilience of the resilient pressure contact members.

What is claimed is:

1. A service plug, comprising:

a plug main body having first terminals for engaging with second terminals by moving the plug main body in a terminal engaging direction, the first terminals electrically connected to each other; a pivot shaft extending from the plus main body in a direction substantially orthogonal to the terminal engaging direction;

a lever connected to the pivot shaft so as to be pivotally movable with respect to the plug main body about the pivot shaft; and a pivot regulating mechanism provided on the lever and the plug main body;

wherein when the lever is substantially parallel to the terminal engaging direction the pivot regulating mechanism prevents the lever from pivoting relative to the plug main body with a predetermined force.

2. The service plug of claim 1, wherein the pivot regulating mechanism includes a recess and a projection, the recess being formed in one of the lever and the plug main body, and the projection being formed on the other one of the lever and the plug main body, and wherein the projection is engageable with the recess, and releasable from engagement with the recess by a force exceeding the predetermined force.

3. The service plug of claim 1, wherein the pivot shaft is fixed to the plug main body, and wherein the pivot regulating mechanism includes a grooved shaft and a resilient contact member, the grooved shaft concentrically fixed to the pivot shaft, and having a recessed groove in an outer circumference thereof, the resilient contact member fixed to the lever, engageable with the recessed groove, and releasable from engagement with the recessed groove by a force exceeding the predetermined force.

4. A circuit switchgear, comprising:

a circuit accommodating unit including second terminals; and a service plug detachably fitted to the circuit accommodating unit, the service plug including:

a plug main body having first terminals for engaging with thc second terminals by moving the plus main body in a terminal engaging direction, the first terminals electrically connected to each other;

a pivot shaft extending from the plug main body in a direction substantially orthogonal to the terminal engaging direction;

a lever connected to the pivot shaft so as to be pivotally movable with respect to the plug main body about the pivot shaft; and a pivot regulating mechanism provided on the lever and the plug main body;

wherein, when the lever is substantially parallel to the terminal engaging direction, the pivot regulating mechanism prevents the lever from pivoting relative to the plug main body with a predetermined force.

5. The circuit switchgear of claim 4, wherein the pivot regulating mechanism includes a recess and a projection, the recess being formed in one of the lever and the plug main body, and the projection being formed on the other one of the lever and the plug main body, and wherein the projection is engageable with the recess, and releasable from engagement with the recess by a force exceeding the predetermined force.

6. The circuit switchgear of claim 4, wherein the pivot shaft is fixed to the plug main body, and wherein the pivot regulating mechanism includes a grooved shaft and a resilient contact member, the grooved shaft concentrically fixed to the pivot shaft, and having a recessed groove in an outer circumference thereof, the resilient contact member fixed to the lever, engageable with the recessed groove, and releasable from engagement with the recessed groove by a force exceeding the predetermined force.

* * * * *